US010612531B2

(12) United States Patent
Jiang

(10) Patent No.: US 10,612,531 B2
(45) Date of Patent: Apr. 7, 2020

(54) HYDRAULICALLY-DRIVEN DOUBLE-ACTING MUD PUMP

(71) Applicant: Huangshan Huirun Machinery Co., Ltd., Huangshan (CN)

(72) Inventor: Jie Jiang, Huangshan (CN)

(73) Assignee: Huangshan Huirun Machinery Co., Ltd., Huangshan (CN)

( * ) Notice: Subject to any disclaimer, the term of this patent is extended or adjusted under 35 U.S.C. 154(b) by 316 days.

(21) Appl. No.: 15/696,396

(22) Filed: Sep. 6, 2017

(65) Prior Publication Data

US 2018/0298887 A1 Oct. 18, 2018

(30) Foreign Application Priority Data

Apr. 18, 2017 (CN) ..... 2017 1 0254680

(51) Int. Cl.

| | |
|---|---|
| ***F04B 9/10*** | (2006.01) |
| ***F04B 9/117*** | (2006.01) |
| ***F04B 15/02*** | (2006.01) |
| ***F04B 13/00*** | (2006.01) |
| ***F04B 9/105*** | (2006.01) |
| ***F04B 17/05*** | (2006.01) |

(52) U.S. Cl.

CPC ..... *F04B 9/1174* (2013.01); *F04B 9/105* (2013.01); *F04B 13/00* (2013.01); *F04B 15/02* (2013.01); *F04B 17/05* (2013.01)

(58) Field of Classification Search

CPC ..... E21B 43/26; F04B 9/1174; F04B 13/00; F04B 15/02

See application file for complete search history.

(56) References Cited

U.S. PATENT DOCUMENTS 3,332,496 A * 7/1967 Anderson ..... E21B 43/26 166/177.5

4,371,958 A * 2/1983 Claycomb ..... E21B 41/0085 175/45

(Continued)

*Primary Examiner* — Matthew R Buck
*Assistant Examiner* — Aaron L Lembo
(74) *Attorney, Agent, or Firm* — Maier & Maier, PLLC

(57) ABSTRACT

The present invention discloses a hydraulically-driven double-acting mud pump, comprising power motors, pressure oil pumps, a three-position four-way hydraulically-actuated directional valve, a hydraulic power end and a mud pump head, the power motors being connected to the pressure oil pumps in a conventional way, the pressure oil pumps being communicated with a port P of the three-position four-way hydraulically-actuated directional valve via a pipeline, a port T of the three-position four-way hydraulically-actuated directional valve being communicated with an oil tank via a pipeline, a port A and a port B of the three-position four-way hydraulically-actuated directional valve being both connected to the hydraulic power end, the hydraulic power end being connected to the mud pump head in a conventional way, a lower end of the mud pump head being communicated with a low-pressure manifold and two sides of the mud pump head being communicated with a high-pressure manifold. The hydraulically-driven double-acting mud pump of the present invention allows for more stable instantaneous flow and pressure of the discharged liquid from the mud pump and reduced fluctuation.

10 Claims, 2 Drawing Sheets

(56) References Cited

U.S. PATENT DOCUMENTS

| | | | | |
|---|---|---|---|---|
| 4,454,598 | A * | 6/1984 | Claycomb | E21B 47/022 175/40 |
| 4,576,358 | A * | 3/1986 | Mott | E21B 21/106 166/319 |
| 10,280,725 | B2 * | 5/2019 | Jiang | E21B 43/26 |
| 2017/0022788 | A1 * | 1/2017 | Oehring | E21B 41/0021 |
| 2018/0266412 | A1 * | 9/2018 | Stokkev G | F04B 11/0058 |

* cited by examiner

HYDRAULICALLY-DRIVEN DOUBLE-ACTING MUD PUMP

This application claims priority to Chinese application number 201710254680.3, filed 18 Apr. 2017, with a title of HYDRAULICALLY-DRIVEN DOUBLE-ACTING MUD PUMP. The above-mentioned patent application is incorporated herein by reference in its entirety.

TECHNICAL FIELD

The present invention relates to the technical field of mud pumps and in particular to a hydraulically-driven double-acting mud pump.

BACKGROUND

As indispensable drilling-related equipment used in construction of geotechnical engineering such as geological exploration and control, exploitation of oil and gas wells and drilling for special purposes, mud pumps are used for conveying, to the drill pipe during the drilling, media such as mud and water which function as cooling and washing the drill pipe and the soil.

At present, most of the existing mud pumps operate in a conventional way in which the reciprocating motion is driven by a mechanical crank-link mechanism. Usually, the reduction of speed is realized by belt drive by using a diesel engine or motor or realized by a gear reducer; and then the piston rod and the plunger of the mud pump head are driven by the crank-link mechanism and the guide slider to do reciprocating motion. In this way, the suction and discharge functions of the mud pump head are achieved. With regard to a conventional mud pump, due to the use of the crank-link mechanism, the running speed of the plunger of the mud pump head changes approximately in a sinusoidal fashion. As a result, the instantaneous flow and pressure of the discharged liquid also change approximately in a sinusoidal fashion, with large fluctuation. In order to decrease the fluctuation in flow and pressure inside the discharge manifold of the mud pump head, as a conventional technical solution, a pulsation damper is provided at the discharge outlet of the mud pump head. However, this increases the weight of the equipment and the difficulty of maintenance.

To meet the growing demands for mud pumps in the construction of geotechnical engineering, the development of a mud pump with novel structure and small fluctuation to replace the conventional mud pump which is driven by a crank-link mechanism has become an inevitable trend.

SUMMARY

An objective of the present invention is to provide a hydraulically-driven double-acting mud pump which allows for more stable instantaneous flow and pressure of the discharged liquid from the mud pump and reduced fluctuation, in order to solve the problems in the prior art.

For this purpose, the present invention provides the following technical solutions.

The present invention provides a hydraulically-driven double-acting mud pump, comprising power motors, pressure oil pumps, a three-position four-way hydraulically-actuated directional valve, a hydraulic power end and a mud pump head, the power motors being connected to the pressure oil pumps in a transmission way, the pressure oil pumps being communicated with a port P of the three-position four-way hydraulically-actuated directional valve via a pipeline, a port T of the three-position four-way hydraulically-actuated directional valve being communicated with an oil tank via a pipeline, a port A and a port B of the three-position four-way hydraulically-actuated directional valve being both connected to the hydraulic power end, the hydraulic power end being connected to the mud pump head in a transmission way, a lower end of the mud pump head being communicated with a low-pressure manifold and two sides of the mud pump head being communicated with a high-pressure manifold.

The hydraulically-driven double-acting mud pump further comprises control oil pumps and a two-position four-way hydraulically-actuated pilot valve, the control oil pumps being driven by control motors, the control oil pumps being communicated with a port P of the two-position four-way hydraulically-actuated pilot valve via a pipeline, a port T of the two-position four-way hydraulically-actuated pilot valve being communicated with the oil tank via a pipeline, a port A and a port B of the two-position four-way hydraulically-actuated pilot valve being communicated with one of two control ports of the three-position four-way hydraulically-actuated directional valve respectively via a pipeline, and the two control ports of the two-position four-way hydraulically-actuated pilot valve being both connected to the hydraulic power end.

Further, the hydraulic power end comprises a first double-rod cylinder and a second double-rod cylinder, a chamber at one end of the first double-rod cylinder is communicated with a chamber at one end of the second double-rod cylinder via a pipeline, a chamber at the other end of the first double-rod cylinder is communicated with the port B of the three-position four-way hydraulically-actuated directional valve via a pipeline, and a chamber at the other end of the second double-rod cylinder is communicated with the port A of the three-position four-way hydraulically-actuated directional valve via a pipeline.

Further, a cushion cylinder is provided within the chamber at the other end of the first double-rod cylinder and within the chamber at the other end of the second double-rod cylinder, the cushion cylinder of the first double-rod cylinder is communicated with one control port of the two-position four-way hydraulically-actuated pilot valve via a pipeline, and the cushion cylinder of the second double-rod cylinder is communicated with the other control port of the two-position four-way hydraulically-actuated pilot valve via a pipeline.

Further, the mud pump head comprises two double-cylinder pumps, four plungers of the mud pump head are connected to piston rods of the first double-rod cylinder and the second double-rod cylinder respectively via couplings, and four suction check valves of the mud pump head are connected in parallel via a low-pressure manifold and four discharge check valves of the mud pump head are connected in parallel via a high-pressure manifold.

Further, the pipelines communicating the chambers of the first double-rod cylinder with the chambers of the second double-rod cylinder are further communicated with a liquid filling loop, and an electronic ball valve is provided in a pipeline between the liquid filling loop and the first and second double-rod cylinders.

Further, a cooler is provided in a pipeline between the port T of the three-position four-way hydraulically-actuated directional valve and the oil tank.

Further, here are two pressure oil pumps and the two pressure oil pumps are arranged in parallel; each of the pressure oil pumps is connected to one of the power motors in a transmission way; and the pressure oil pumps are variable displacement plunger pumps and the control oil pumps are duplex pumps, with one pump outlet of the duplex pump being communicated with the port P of the two-position four-way hydraulically-actuated pilot valve via a pipeline and the other pump outlet thereof being communicated with a variable displacement mechanism of the variable displacement plunger pump via a pipeline.

Further, a check valve and a pilot relief valve are provided in a pipeline between the one pump outlet of the duplex pump and the port P of the two-position four-way hydraulically-actuated pilot valve and in a pipeline between the other pump outlet and the variable displacement mechanism of the variable displacement plunger pump.

Further, a check valve, a pilot relief valve, a thermometer, a piezometer, a pressure transmitter and a filter are provided in a pipeline between the control oil pump and the port P of the two-position four-way hydraulically-actuated pilot valve.

Further, the oil tank serves as a skid chassis, and all the power motors, the pressure oil pumps, the control oil pumps and the control motors are arranged on the oil tank; and the hydraulic power end is arranged in the middle of the oil tank, and the mud pump head is connected to the hydraulic power end via a pull rod.

Compared with the prior art, the hydraulically-driven double-acting mud pump of the present invention has the following technical effects.

The mud pump head in the present invention has more stable running speed, stable output force, small overall vibration, more stable instantaneous flow and pressure of the discharged liquid, small fluctuation, and no water hammer. Pumping with long stroke, low stoke times and large displacement is easily achievable, the wear to quick-wear parts such as pump valves is reduced, and the maintenance load, the shutdown maintenance time and the maintenance expense are reduced. The hydraulically-driven double-acting mud pump of the present invention is suitable for operating under high pressure with large displacement for a long period of time in oil wells, and can complete the normal pumping of mud with a high concentration of sand.

BRIEF DESCRIPTION OF THE DRAWING

To describe the technical solutions of the embodiments of the present invention or in the prior art more clearly, drawings to be used for the description of the embodiments will be briefly introduced below. Apparently, the drawings to be described below are merely some embodiments of the present invention. Other drawings may be obtained by a person of ordinary skill in the art according to those drawings without paying any creative effort.

FIG. 2 is a stereoscopic structure diagram of the hydraulically-driven double-acting mud pump according to the present invention, in which:

1: oil tank;
2: pressure oil pump;
3: control oil pump;
4: check valve;
5: pilot relief valve;
6: thermometer;
7: piezometer;
8: pressure transmitter;
9: filter;
10: cooler;
11: three-position four-way hydraulically-actuated directional valve;
12: two-position four-way hydraulically-actuated pilot valve;
13: mud pump head;
14: first double-rod cylinder;
15: second double-rod cylinder;
16: liquid filling loop;
17: electronic ball valve;
18: high-pressure manifold;
19: low-pressure manifold;
20: cushion cylinder;
21: hydraulic power end;
22: electric control system;
23: pull rod;
I: mud pump cylinder I;
II: mud pump cylinder II;
III: mud pump cylinder III; and
IV: mud pump cylinder IV.

DETAILED DESCRIPTION

The technical solutions in the embodiments of the present invention will be described clearly and completely below with reference to the drawings in the embodiments of the present invention. Obviously, the described embodiments are merely some but not all of the embodiments of the present invention. All other embodiments obtained by a person of ordinary skill in the art on the basis of the embodiments of the present invention without paying any creative effort shall be included within the protection scope of the present invention.

An objective of the present invention is to provide a hydraulically-driven double-acting mud pump which allows for more stable instantaneous flow and pressure of the discharged liquid from the mud pump and reduced fluctuation, in order to solve the problems in the prior art.

To make the objectives, features and advantages of the present invention clearer, the present invention will be further described in detail by specific implementations with reference to the accompanying drawings.

Figure 1:
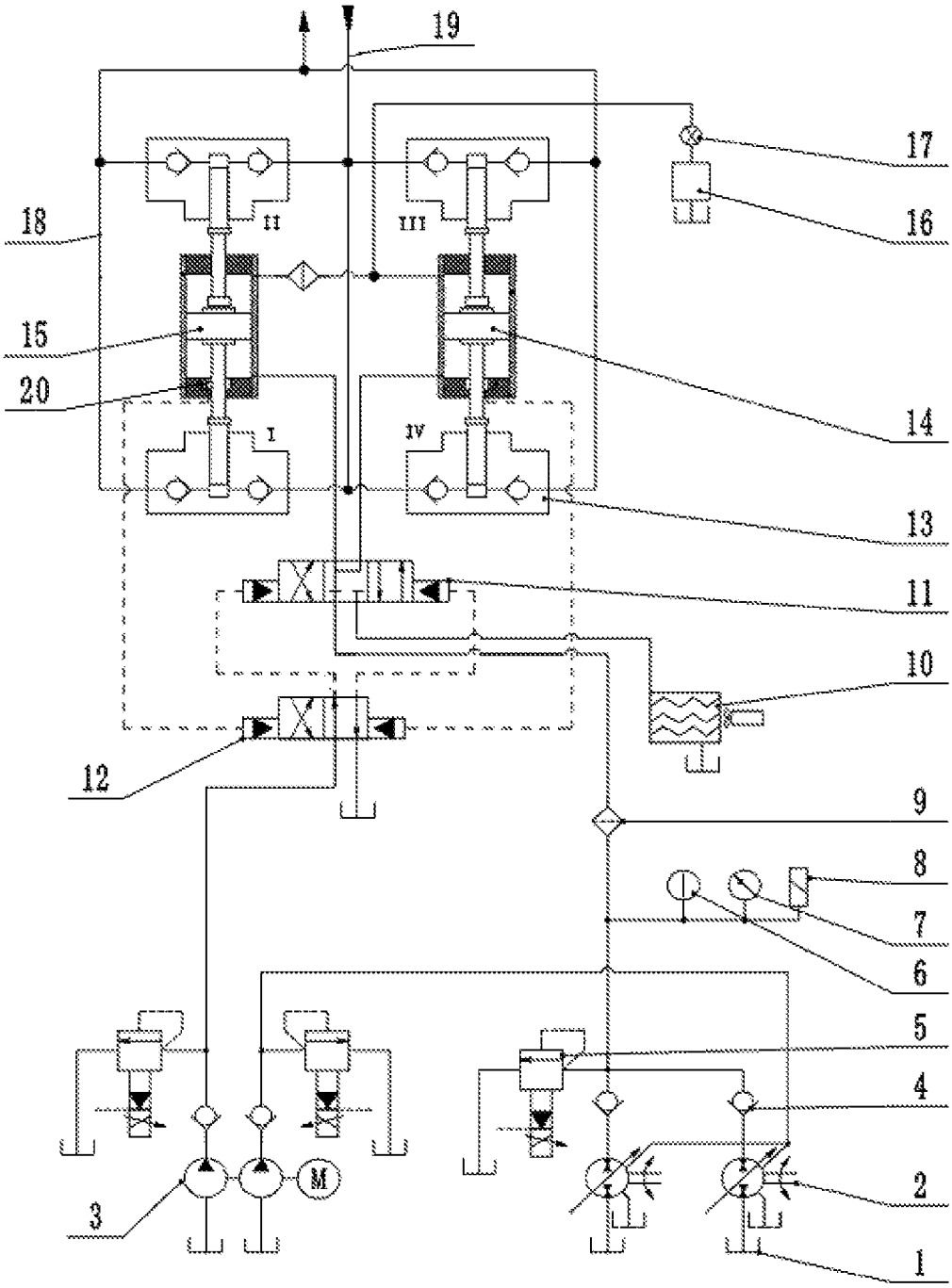
FIG. 1 is a hydraulic principle diagram of a hydraulically-driven double-acting mud pump according to the present invention.
Figure 2:
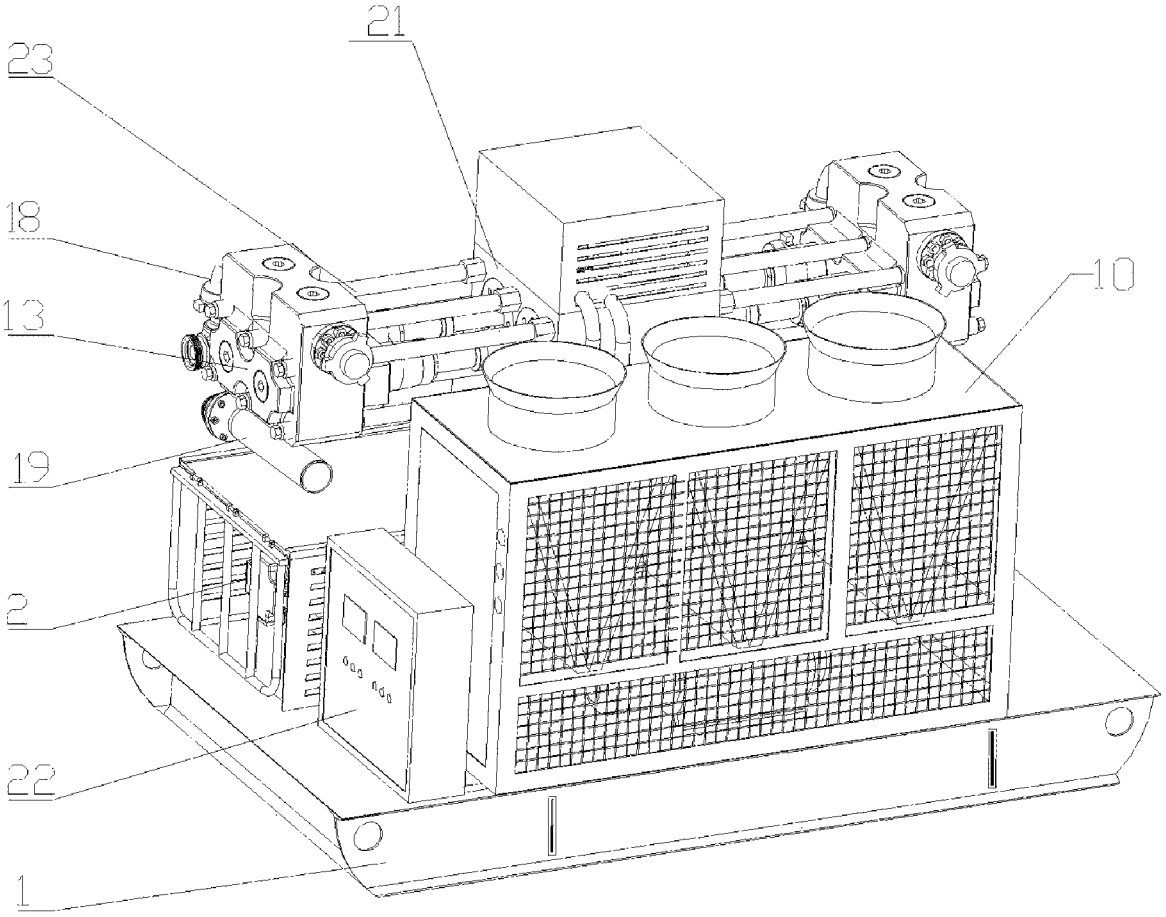

Referring to FIG. 1 and FIG. 2, the embodiment provides a hydraulically-driven double-acting mud pump, comprising power motors, pressure oil pumps 2, a three-position four-way hydraulically-actuated directional valve 11, a hydraulic power end 21 and a mud pump head 13, the power motors being connected to the pressure oil pumps 2 in a transmission way, the pressure oil pumps 2 being communicated with a port P of the three-position four-way hydraulically-actuated directional valve 11 via a pipeline, a port T of the three-position four-way hydraulically-actuated directional valve 11 being communicated with a cooler 10 and an oil tank 1 via a pipeline.

The hydraulically-driven double-acting mud pump further comprises control oil pumps 3 and a two-position four-way hydraulically-actuated pilot valve 12, the control oil pumps 3 being driven by control motors, the control oil pumps 3 being communicated with a port P of the two-position four-way hydraulically-actuated pilot valve 12 via a pipeline, a port T of the two-position four-way hydraulically-actuated pilot valve 12 being communicated with the oil tank 1 via a pipeline, a port A of the two-position four-way hydraulically-actuated pilot valve 12 being communicated with a left control port of the three-position four-way hydraulically-actuated directional valve 11 via a pipeline, and a port B of the two-position four-way hydraulically-actuated pilot valve 12 being communicated with a right control port of the three-position four-way hydraulically-actuated directional valve 11 via a pipeline.

There are two pressure oil pumps 2 and the two pressure oil pumps 2 are arranged in parallel; each of the pressure oil pumps 2 is driven by a power motor; the pressure oil pumps 2 are preferably variable displacement plunger pumps and the control oil pumps 3 are preferably duplex pumps, with one pump outlet of the duplex pump being communicated with the port P of the two-position four-way hydraulically-actuated pilot valve 12 via a pipeline and the other pump outlet thereof being communicated with a variable displacement mechanism of the variable displacement plunger pump via a pipeline for the purpose of controlling the flow of the variable displacement plunger pump. A check valve 4 and a pilot relief valve 5 are provided in a pipeline between the one pump outlet of the duplex pump and the port P of the two-position four-way hydraulically-actuated pilot valve 12 and in a pipeline between the other pump outlet and the variable displacement mechanism of the variable displacement plunger pump. A check valve 4, a pilot relief valve 5, a thermometer 6, a piezometer 7, a pressure transmitter 8 and a filter 9 are provided in a pipeline between the control oil pump 3 and the port P of the two-position four-way hydraulically-actuated pilot valve 12.

The hydraulic power end 21 comprises a first double-rod cylinder 14 and a second double-rod cylinder 15, a chamber at an upper end of the first double-rod cylinder 14 is communicated with a chamber at an upper end of the second double-rod cylinder 15 via a pipeline, the pipeline is further communicated with a liquid filling loop 16, and an electronic ball valve 17 is provided in the pipeline between the liquid filling loop 16 and the first and second double-rod cylinders 14, 15. A chamber at a lower end of the first double-rod cylinder 14 is communicated with the port B of the three-position four-way hydraulically-actuated directional valve 11 via a pipeline, and a chamber at a lower end of the second double-rod cylinder 15 is communicated with the port A of the three-position four-way hydraulically-actuated directional valve 11 via a pipeline. A cushion cylinder 20 is provided within the chamber at the lower end of the first double-rod cylinder 14 and within the chamber at the lower end of the second double-rod cylinder 15, the cushion cylinder 20 of the first double-rod cylinder 14 is communicated with the right control port of the two-position four-way hydraulically-actuated pilot valve 12 via a pipeline, and the cushion cylinder 20 of the second double-rod cylinder 15 is communicated with the left control port of the two-position four-way hydraulically-actuated pilot valve 12 via a pipeline.

The lower end of the mud pump head 13 is communicated with a low-pressure manifold and two sides of the mud pump head are respectively communicated with a high-pressure manifold. The mud pump head 13 has total four cylinders, respectively: mud pump cylinder I, mud pump cylinder II, mud pump cylinder III and mud pump cylinder IV. The plunger of the mud pump head I is connected to the piston rod at the lower end of the second double-rod cylinder 15 via a coupling; the plunger of the mud pump head II is connected to the piston rod at the upper end of the second double-rod cylinder 15 via a coupling; the plunger of the mud pump head III is connected to the piston rod at the upper end of the first double-rod cylinder 14 via a coupling; and the plunger of the mud pump head IV is connected to the piston rod at the lower end of the first double-rod cylinder 14 via a coupling. Four suction check valves of the mud pump head 13 are connected in parallel via a low-pressure manifold 19 and four discharge check valves of the mud pump head are connected in parallel via a high-pressure manifold 18. The suction check valves and the discharge check valves are preferably ball valves, in order to improve the stability and the service life.

The oil tank 1 serves as a skid chassis, and all the power motors, the pressure oil pumps 2, the control oil pumps 3 and the control motors are arranged on the oil tank 1. The hydraulic power end 21 is arranged in the middle of the oil tank 1, close to one side; and the mud pump head 13 is connected to the hydraulic power end 21 via a pull rod 23. The cooler 10 and the electric control system 22 are arranged on the other side of the oil tank 1, and the electric control system 22 is located on one side of the cooler 10. The power motors, the control motors, the fan for the cooler 10, the thermometer 6, the piezometer 7, the pressure transmitter 8 and the electronic ball valve 17 are electrically connected to the electric control system 22. The electric control system 22 is used for monitoring the running state of the hydraulically-driven double-acting mud pump, and for controlling the ON/OFF of the power motors, the control motors, the fan for the cooler 10 and the electronic ball valve 17.

The operating principle of the embodiment is as follows.

A cushion cylinder 20 is provided within the chamber at the other end of the first double-rod cylinder 14 and within the chamber at the other end of the second double-rod cylinder 15. When the pistons of the double-rod cylinders run to the two ends, the pistons and the cushion cylinders 20 form a partial sealed chamber, and the resulting high-pressure oil flow controls the directional switchover of the two-position four-way hydraulically-actuated pilot valve 12 and thus facilitates the directional switchover of the three-position four-way hydraulically-actuated directional valve 11.

As shown in FIG. 1, both the cylinder bore and the piston rod of the first double-rod cylinder 14 are the same as those of the second double-rod cylinder 15. When the two-position four-way hydraulically-actuated pilot valve 12 is in the left position, the three-position four-way hydraulically-actuated directional valve 11 is in the right position. Now, the port P of the main oil path is communicated with the port A, and the port B of the oil return path is communicated with the port T. Liquid is filled under high pressure to the chamber at the lower end of the second double-rod cylinder 15, and oil is returned under low pressure to the chamber at the lower end of the first double-rod cylinder 14. The piston rod of the second double-rod cylinder 15 moves upward. Since the chamber at the upper end of the first double-rod cylinder 14 is communicated with the chamber at the upper end of the second double-rod cylinder 15, the high-pressure oil flow inside the chamber at the upper end of the second double-rod cylinder 15 flows to the chamber at the upper end of the first double-rod cylinder 14. The high oil pressure forces the piston rod of the first double-rod cylinder 14 to move downward. Under the pressure from the high-pressure oil inside the chamber at the lower end of the second double-rod cylinder 15, the two-position four-way hydraulically-actuated pilot valve 12 is kept in the left position. Now, the fluid medium inside the mud pump cylinder II and the mud pump cylinder IV is compressed, and then discharged, in form of high-pressure fluid, along the high-pressure manifold 18 through the discharge check valves. Meanwhile, the volume cavities of the mud pump cylinder I and the mud pump cylinder III are in negative pressure so that the fluid medium is sucked therein along the low-pressure manifold 19 through the suction check valves.

When the piston rod of the first double-rod cylinder 14 approaches the lower limit position, the piston rod of the first double-rod cylinder 14 slows down, and the oil pressure inside the cushion cylinder 20 rises. When the set pressure (35 MPa) of the two-position four-way hydraulically-actuated pilot valve 12 is reached, the two-position four-way hydraulically-actuated pilot valve 12 is switched to the right position, and the three-position four-way hydraulically-actuated directional valve 11 is switched to the left position. Now, the port P of the main oil path is communicated with the port B, and the port A of the oil return path is communicated with the port T. Liquid is filled under high pressure to the chamber at the lower end of the first double-rod cylinder 14, and oil is returned under low pressure to the chamber at the lower end of the second double-rod cylinder 15. The piston rod of the first double-rod cylinder 14 moves upward, and the piston rod of the second double-rod cylinder 15 moves downward. Under the pressure from the high-pressure oil inside the chamber at the lower end of the first double-rod cylinder 14, the two-position four-way hydraulically-actuated pilot valve 12 is kept in the right position. Now, the fluid medium inside the mud pump cylinder I and the mud pump cylinder III is compressed, and then discharged, in form of high-pressure fluid, along the high-pressure manifold 18 through the discharge check valves. Meanwhile, the volume cavities of the mud pump cylinder II and the mud pump cylinder IV are in negative pressure so that the fluid medium is sucked therein along the low-pressure manifold 19 through the suction check valves.

When the piston rod of the second double-rod cylinder 15 approaches the lower limit position, the piston rod of the second double-rod cylinder 15 slows down, and the oil pressure inside the cushion cylinder 20 rises. When the set pressure of the two-position four-way hydraulically-actuated pilot valve 12 is reached, the two-position four-way hydraulically-actuated pilot valve 12 is switched to the left position, and the three-position four-way hydraulically-actuated directional valve 11 is switched to the right position.

Such repeated operations of the piston rods of the first double-rod cylinder 14 and the second double-rod cylinder 15 drive the mud pump head 14 to work, so that the volume cavity of the mud pump head 13 alternately changes between high pressure and negative pressure and the fluid is sucked therein via the low-pressure manifold 19 and then discharged via the high-pressure manifold 18. In this way, the pumping of the fluid medium is completed.

The running speed of the piston rod in this embodiment depends upon the flow from the variable displacement plunger pump. During the reciprocating motion of the hydraulic oil cylinder, the high-pressure oil inside the sealed chamber also provides for a braking effect to the piston rod. Therefore, the hydraulic impact on the system from the sudden directional switchover of the piston rod is greatly decreased. In this embodiment, the automatic directional switchover function is realized by controlling the three-position four-way hydraulically-actuated directional valve 11 through two-position four-way hydraulically-actuated pilot valve 12 by using the high-pressure oil in the cushion cylinders 20 at the two ends of the hydraulic oil cylinder. This directional switchover has the advantages of stability and reliability, short time required for directional switchover, no dead point, and low hydraulic impact. In this embodiment, the linear motion of the conventional crank-link mechanism is replaced by the linear motion of the piston rods of the double-rod cylinders, the running speed of the piston rods of the double-rod cylinders is stable, and the driving force is high. Meanwhile, by increasing the stroke of the piston of the mud pump head 13 and of the piston rods of the double-rod cylinders, the stroke times of the double-rod cylinders per unit time can be reduced. Thus, the operating state of the suction check valves and the discharge check valves of the mud pump head 13 is more stable and the cavitation events are greatly reduced.

The hydraulically-driven double-acting mud pump in this embodiment has simple structure, stable pressure and flow of the output mud, and high volume efficiency. Pumping with long stroke, low stoke times, high pressure and large displacement is easily achievable, and the performance of the mud pump can be greatly improved. Furthermore, the hydraulically-driven double-acting mud pump has the advantages of small size, low weight, long service life, no impact, small inertia, and accurate and reliable directional switchover. By using the variable displacement plunger pump as a pressure oil pump, it is easy to realize stepless speed change, automatic control, overload protection, etc. The pressurization can be realized by rationally designing the effective action area between the cylinder of the pressure oil pump and the double-rod cylinder as desired. In this way, the process requirements on the high-pressure pump are met. A single hydraulically-driven double-acting mud pump in this embodiment can have an output power of 1200 kw, a highest operating pressure of 63 MPa and a maximum flow of 3.86 $m^3$/min. The hydraulically-driven double-acting mud pump in this embodiment is suitable for operating under high pressure with large displacement for a long period of time in oil wells, and can complete the normal pumping of liquid with a high concentration of sand and can also undertake the tasks of drilling pumps or fracturing pumps.

The principle and implementations of the present invention have been described by specific examples herein. The description of embodiments is merely used for helping the understanding of the method of the present invention and its key concepts. Meanwhile, for a person of ordinary skill in the art, changes may be made to the specific implementations and application ranges according to the concepts of the present invention. In conclusion, the contents of the description should not be considered as any limitation to the present invention.

What is claimed is:

1. A hydraulically-driven double-acting mud pump, comprising power motors, pressure oil pumps, a three-position four-way hydraulically-actuated directional valve, a hydraulic power end and a mud pump head, the power motors being connected to the pressure oil pumps in a transmission way, the pressure oil pumps being communicated with a port P of the three-position four-way hydraulically-actuated directional valve via a first pipeline, a port T of the three-position four-way hydraulically-actuated directional valve being communicated with an oil tank via a second pipeline, a port A and a port B of the three-position four-way hydraulically-actuated directional valve being both connected to the hydraulic power end, the hydraulic power end being connected to the mud pump head in a transmission way, a lower end of the mud pump head being communicated with a low-pressure manifold and two sides of the mud pump head being communicated with a high-pressure manifold; and further comprising control oil pumps and a two-position four-way hydraulically-actuated pilot valve, the control oil pumps being driven by control motors, the control oil pumps being communicated with a port P of the two-position four-way hydraulically-actuated pilot valve via a third pipeline, a port T of the two-position four-way hydraulically-actuated pilot valve being communicated with the oil tank via a fourth pipeline, a port A and a port B of the two-position four-way hydraulically-actuated pilot valve being communicated with one of two control ports of the three-position four-way hydraulically-actuated directional valve respectively via a fifth pipeline, and the two control ports of the two-position four-way hydraulically-actuated pilot valve being both connected to the hydraulic power end.

2. The hydraulically-driven double-acting mud pump according to claim 1, characterized in that the hydraulic power end comprises a first double-rod cylinder and a second double-rod cylinder, a chamber at one end of the first double-rod cylinder is communicated with a chamber at one end of the second double-rod cylinder via a sixth pipeline, a chamber at the other end of the first double-rod cylinder is communicated with the port B of the three-position four-way hydraulically-actuated directional valve via a seventh pipeline, and a chamber at the other end of the second double-rod cylinder is communicated with the port A of the three-position four-way hydraulically-actuated directional valve via an eighth pipeline.

3. The hydraulically-driven double-acting mud pump according to claim 2, characterized in that a cushion cylinder is provided within the chamber at the other end of the first double-rod cylinder and within the chamber at the other end of the second double-rod cylinder, the cushion cylinder of the first double-rod cylinder is communicated with one control port of the two-position four-way hydraulically-actuated pilot valve via a ninth pipeline, and the cushion cylinder of the second double-rod cylinder is communicated with the other control port of the two-position four-way hydraulically-actuated pilot valve via a tenth pipeline.

4. The hydraulically-driven double-acting mud pump according to claim 2, characterized in that the mud pump head comprises two double-cylinder pumps, four plungers of the mud pump head are connected to piston rods of the first double-rod cylinder and the second double-rod cylinder respectively via couplings, and four suction check valves of the mud pump head are connected in parallel via a low-pressure manifold and four discharge check valves of the mud pump head are connected in parallel via a high-pressure manifold.

5. The hydraulically-driven double-acting mud pump according to claim 2, characterized in that the sixth pipelines communicating the chambers of the first double-rod cylinder with the chambers of the second double-rod cylinder are further communicated with a liquid filling loop, and an electronic ball valve is provided in an eleventh pipeline between the liquid filling loop and the first and second double-rod cylinders.

6. The hydraulically-driven double-acting mud pump according to claim 1, characterized in that a cooler is provided in the second pipeline between the port T of the three-position four-way hydraulically-actuated directional valve and the oil tank.

7. The hydraulically-driven double-acting mud pump according to claim 1, characterized in that there are two pressure oil pumps and the two pressure oil pumps are arranged in parallel; each of the pressure oil pumps is connected to one of the power motors in a transmission way; and the pressure oil pumps are variable displacement plunger pumps and the control oil pumps are duplex pumps, with one pump outlet of the duplex pump being communicated with the port P of the two-position four-way hydraulically-actuated pilot valve via a twelfth pipeline and the other pump outlet thereof being communicated with a variable displacement mechanism of the variable displacement plunger pump via a thirteenth pipeline.

8. The hydraulically-driven double-acting mud pump according to claim 7, characterized in that a check valve and a pilot relief valve are provided in the twelfth pipeline between the one pump outlet of the duplex pump and the port P of the two-position four-way hydraulically-actuated pilot valve and in the thirteenth pipeline between the other pump outlet and the variable displacement mechanism of the variable displacement plunger pump.

9. The hydraulically-driven double-acting mud pump according to claim 7, characterized in that a check valve, a pilot relief valve, a thermometer, a piezometer, a pressure transmitter and a filter are provided in the twelfth pipeline between the control oil pump and the port P of the two-position four-way hydraulically-actuated pilot valve.

10. The hydraulically-driven double-acting mud pump according to claim 1, characterized in that the oil tank serves as a skid chassis, and all the power motors, the pressure oil pumps, the control oil pumps and the control motors are arranged on the oil tank; and the hydraulic power end is arranged in the middle of the oil tank, and the mud pump head is connected to the hydraulic power end via a pull rod.

* * * * *